United States Patent [19]

Richter

[11] 4,324,121

[45] Apr. 13, 1982

[54] KEY RING

[76] Inventor: Herbert Richter, Birkenfelder Str. 1-7, Pforzheim-Bue, Fed. Rep. of Germany, 7530

[21] Appl. No.: 116,273

[22] Filed: Jan. 28, 1980

[30] Foreign Application Priority Data

Jan. 30, 1979 [DE] Fed. Rep. of Germany ... 7902447[U]
Feb. 12, 1979 [DE] Fed. Rep. of Germany ... 7903847[U]

[51] Int. Cl.[3] ..... A47G 29/10
[52] U.S. Cl. ..... 70/459; 70/DIG. 55
[58] Field of Search ..... 70/459, 456 R, DIG. 54, 70/DIG. 55; 150/40; 24/3 K

[56] References Cited

U.S. PATENT DOCUMENTS 1,626,987 5/1927 Venegas ..... 70/459
2,224,073 12/1940 Augenstein ..... 70/459
2,855,775 10/1958 Marien ..... 70/459
4,129,021 12/1978 Bentini ..... 70/456 R

FOREIGN PATENT DOCUMENTS 1215876 11/1959 France ..... 70/459

*Primary Examiner*—Robert L. Wolfe
*Attorney, Agent, or Firm*—Klaus J. Bach

[57] ABSTRACT

A key ring which includes a metal ring with an open segment area for the insertion and removal of keys has the metal ring mounted in a circular guide groove of a handle portion such that the ring is rotatable therein. A latch is slidably disposed in a passage in the handle portion and spring-biased into engagement with the metal ring for locking the metal ring to prevent its rotation.

Means are provided for disengaging the latch so as to permit rotation of the metal ring.

7 Claims, 8 Drawing Figures

KEY RING

BACKGROUND OF THE INVENTION

1. Field of the Invention

The invention relates to a key ring comprising a metal ring with an open segment area for insertion and removal of keys. The ring is mounted in a handle portion having a circular guide groove receiving the ring such that it is rotatable therein, and a latch is associated with the handle portion for locking the metal ring to prevent its rotation.

2. Description of the Prior Art

In some key rings designs the spring biased latches consist of springs in the form of hooks. If the spring consists of metal the spring usually is provided with a bent portion forming the hook; if the spring consists of plastic it usually has a protrusion which extends into the cutaway segment of the ring for locking the ring in position. An extension of the latch usually protrudes slightly from the handle so that, when depressed, the hook disengages the ring and permits rotation thereof. Upon rotation of the ring, the cutout area thereof is exposed permitting insertion of keys into the ring. Upon returning of the ring the latch again engages the ring for locking it in position.

In such a key ring, however, the latch extension has to protrude from the handle an appreciable amount so that the latch can be actuated; but this also facilitates unintended release of the ring so that the keys may be lost. Furthermore, praxis has shown that engagement of the ring by the hooks of the spring latch is not absolutely secure since the latch can be disengaged relatively easily by forced rotation of the ring at least in one direction of rotation resulting possibly in a loss of the keys from the key ring.

It is accordingly desirable to provide a key ring of the type described in which the key holding ring can be securely locked, that is in which unintended loss of the keys becomes quite unlikely, but which nevertheless has an attractive appearance.

SUMMARY OF THE INVENTION

A key ring has a metal ring with an open segment area disposed in a circular guide groove formed in a handle such that the ring is rotatably retained therein. A passage is formed in said handle such that it intersects the groove and a latch is slidably disposed in the passage and biased into intersecting position with the groove such that the latch engages the ring when its open segment area is positioned in alignment with the latch passage so as to lock the ring with its open segment area disposed within the handle. The latch passage extends essentially normal to the annular groove within the handle so that forced rotation of the ring in either direction when engaged by the latch will only force the latch in abutment with the side walls of the latch passage but will not easily result in a latch opening force. Overpowering of the biasing means for the latch, that is disengagement of the latch from the ring, if not desired, is therefore impossible.

In one embodiment the latch passage extends longitudinally within the handle in the same plane in which the ring is disposed such that an operating slide member slidably disposed in the handle and having a pin engaging the latch does not need to protrude from then handle and is not accidentally operable. It is then further possible to provide a ring at the opposite ends of the handle with only one double sided locking mechanism disposed in the handle in a latch passage extending between the two rings and intersecting both ring receiving grooves. Latches are arranged at opposite ends of the passage with spring means disposed in the passage between the two latches. This provides for a double key ring capable of accepting twice the amount of keys and permitting separation of the rings into two groups to facilitate retrieval.

The spring is preferably a lyre-formed double spring having latch members at opposite ends thereof. The latch members may be parts of the end portions of the spring or they may be round pins or balls disposed at the opposite ends of the spring and movable by the spring into the open segment area of the ring. Unintended rotation of the ring, although not impossible, would however require such large forces that disengagement of the latches from the rings is highly improbable. Loss of the keys from the key rings is therefore practically impossible with the arrangement described.

The spring and latch are preferably a single part formed from plastic material and, as such, inexpensive to manufacture.

In an arrangement which is especially simple and inexpensive to manufacture, the latches at opposite ends of the spring are sufficiently wide to protrude at least at one side slightly from the handle so that the latch members can be moved in the handle passage against the force of the spring so as to permit rotation of the metal ring. This eliminates the need for a release mechanism such as projections or slides for the actuation of the latch. The latch member actually becomes a part of the handle which is relatively movable for disengagement of the metal ring and eliminates the need for an additional part in the handle for operating the latch.

The latch may further be in the form of a pintype member having a window of a cross-section in correspondence with that of the ring which member is arranged in a passage extending through the open segment area of the ring and is slidable therein against the force of a spring. The window is so arranged that movement of the member to its end position against the force of the spring permits rotation of the ring through the window.

Suitably, the member is supported in the handle on a leaf spring which is mounted in the handle and supplies the spring forces for returning the member to its neutral position and which supports the member in the passage extending through the circular guide groove.

DESCRIPTION OF THE PREFERRED EMBODIMENTS

Figure 1:
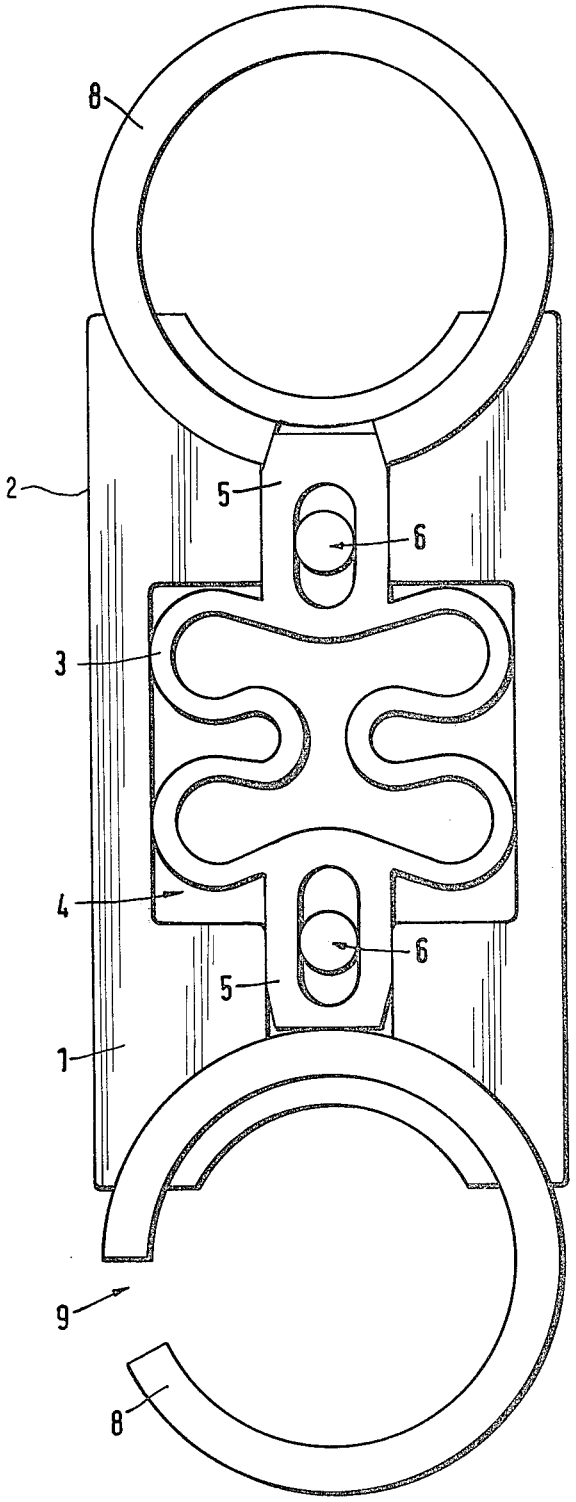
FIG. 1 shows the inside of one half of a handle with the double spring and metal rings disposed therein.
Figure 2:
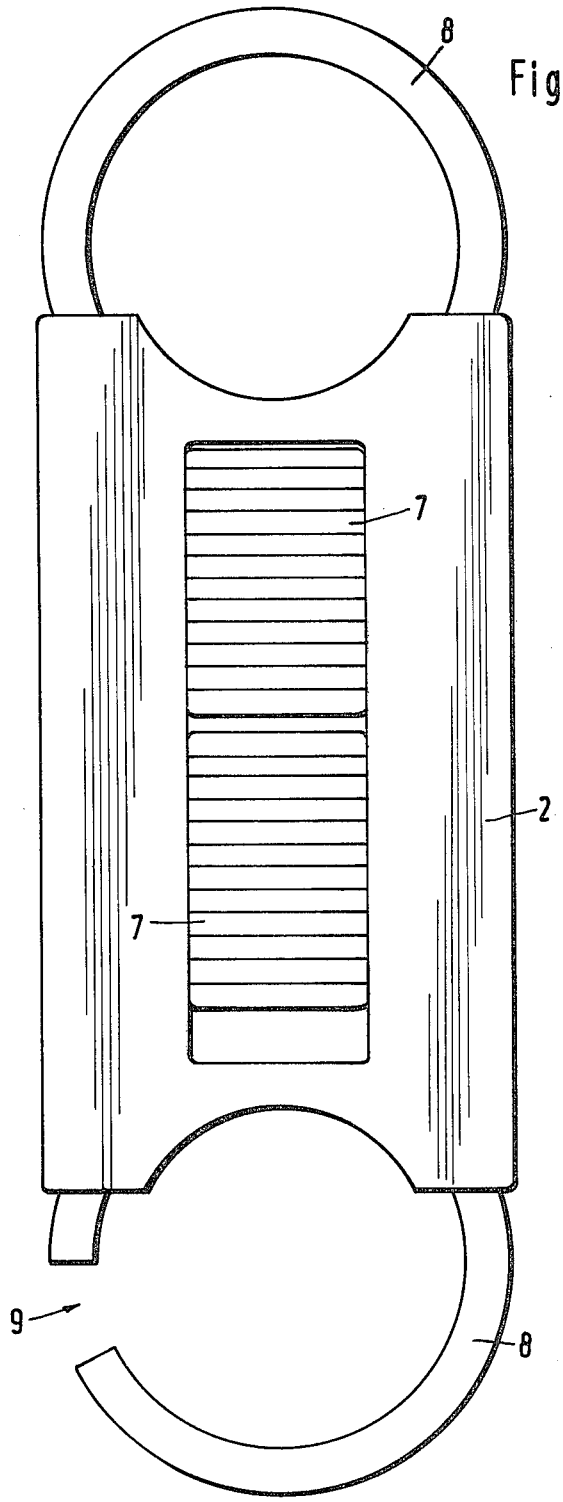
FIG. 2 is a plan view of the key ring.

As shown in FIGS. 1 and 2 one half 1 of a handle portion 2 has a double spring 3 in the form of a lyre disposed in a cavity 4 of the handle portion. The double spring 3 has latch cams 5 at its opposite ends. Each latch cam 5 has an opening 6 formed therethrough into which pins of slide plates 7 extend which slide plates 7 are slidably supported on the outside of the handle portion 2. The handle portion 2 has annular grooves or passages rotatably receiving metal rings 8 which have open segment areas 9.

In FIG. 1, one of the metal rings 8 is shown locked in position by one of the latch cams 5 of the double spring 3 while the opposite metal ring 8 is shown in an angular position in which its open segment area 9 is outside the handle portion 2 for the removal or reception of keys. FIG. 1 clearly demonstrates that firm engagement of the wedge type side faces of the latch cam 5 with the end surfaces of the metal ring open segment area safely prevents unintended rotation of the metal ring 8. On the other hand, the latch cams 5 can be easily moved out of the open segment area of the ring 8 simply by the respective slide plate 7 on the surface of the handle 2 so as to cause disengagement of the metal ring permitting rotation thereof in order to expose the open segment area 9. Returning of the metal ring 8 such that its open segment area moves back into the path of the latch cam will permit the latch cam again to engage the open segment area 9 of the ring 8 under the force of the spring 3 so as to lock the metal ring 8 securely in position.

Figure 3:
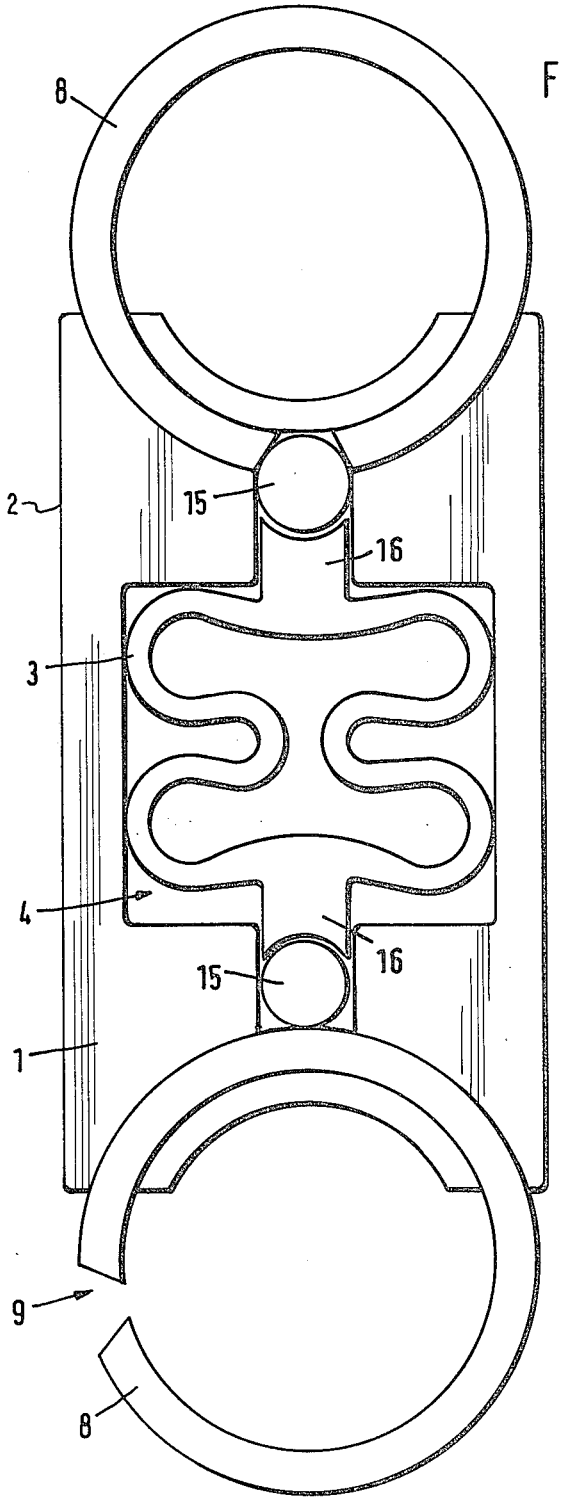
FIG. 3 is a view similar to that of FIG. 1 but including balls as latch elements.

FIG. 3 shows another embodiment wherein the latch cams are replaced by balls 15. Again, a double spring 3 in the form of a lyre is disposed in the cavity 4 of one side of a handle portion 1. The double spring 3 has bosses 16 formed at opposite ends thereof which bosses 16 engage the balls 15 so as to force them into open segment areas 9 of the metal rings 8. One of the balls in the upper part of FIG. 3 is shown disposed within the open segment area 9 of the ring 8. The cut-off surfaces of the ring 8 are wedge-shaped such that forceful rotation of the metal ring 8 will move the ball 15 out of the open segment area 9. Rotation of the metal ring 8 will then unblock the open segment area 9 so that keys can be removed or inserted. Returning of the metal ring 8 will cause the ball 15 to snap back into the open segment area 9 for locking of the ring 8 as shown in the upper part of FIG. 3.

Figure 4:
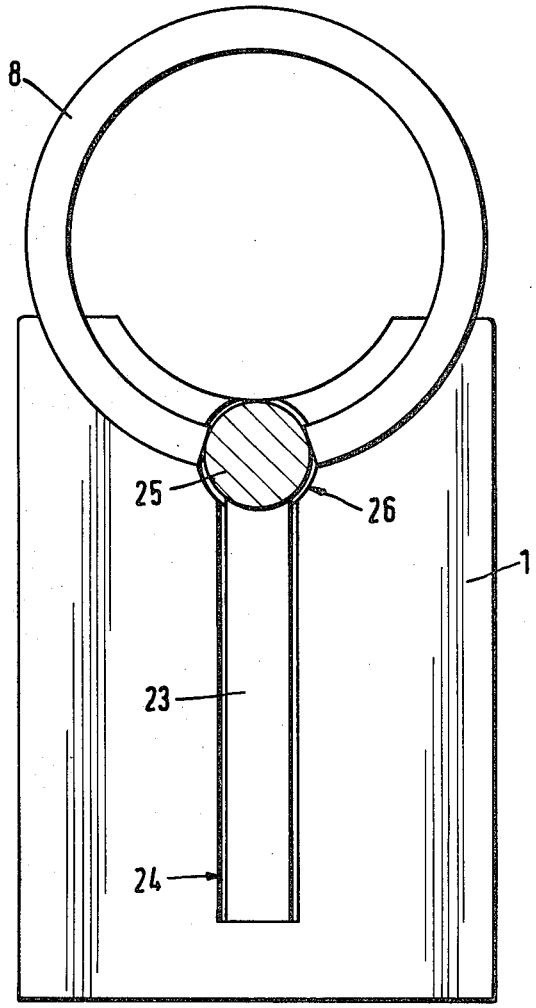
FIG. 4 is a view of the inside of a handle half.
Figure 5:
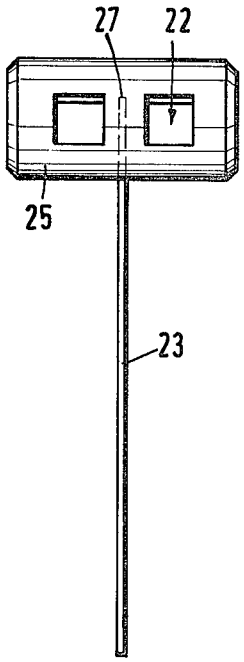
FIG. 5 shows a pin-type latch member mounted on a leaf spring.

FIGS. 4 and 5 show still another embodiment wherein one part 1 of a handle portion has a cavity 24 in which there is mounted a leaf spring 23 which carries a pin 25 at its free end. The pin 25 is guided within a passage 26 extending through the handle portion 1 and having an axis normal to the plane of the ring 8 and intersecting the ring 8. The pin 25 has openings 22 which correspond in cross-section to the cross-section of the ring. The two openings 22 of the pin 25 (FIG. 5) are separated by a web portion 27 which in the neutral position of the pin 25 prevents rotation of the ring 8. If, however, the pin 25 is displaced from its neutral position against the force of the leaf spring 23, one of the openings 22 moves into alignment with the guide groove 10 within handle portion 1 such that the metal ring can be rotated through the opening 27 until the open segment area 9 of the metal ring 8 is exposed. Upon returning of the metal ring 8 to its original or locked position the pin 25 snaps, under the force of leaf opening 23, back to its neutral position thereby locking the metal ring 8.

Figure 6:
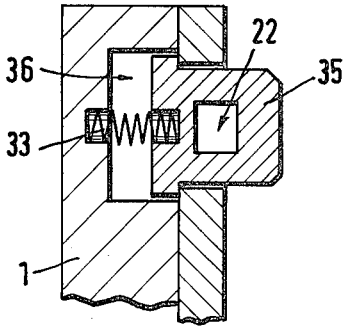
FIG. 6 shows a similar pin-type latch member biased by a coil spring.

In still another embodiment of the invention as shown in FIG. 6, a button 35 is guided in a cavity 36. A spring 33 is disposed in the cavity behind the button 35 and the button 35 is movable into the cavity 36 against the force of the spring 33. Again, the button 35 has an opening 22 which, when moved into alignment of the ring guide groove 10, by pressing of the button 35, permits rotation of the metal ring 8.

Figure 7:
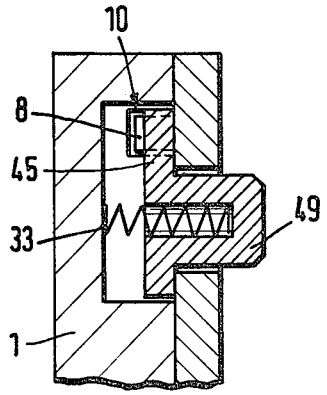
FIG. 7 shows another embodiment of a latch member.
Figure 8:
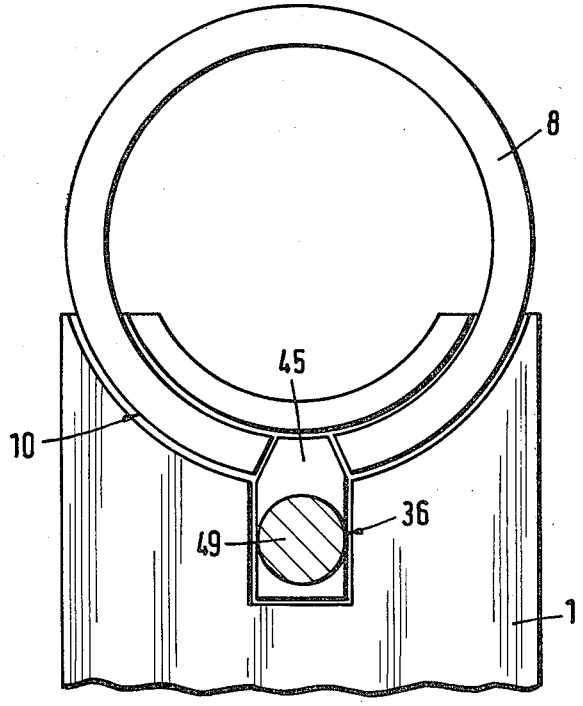
FIG. 8 shows a plan view of the arrangement of FIG. 7.

As shown in FIGS. 7 and 8, a button 49 may also be provided with a latch portion 45 which extends into the annular guide groove 10 of the metal ring 8. Again, a spring 33 is disposed in the cavity 36 behind the button 49 such that pressing of the button causes movement of the button and the latch portion into the cavity 36 for release of the metal ring 8 permitting its rotation.

What is claimed is:

1. A key ring comprising: a handle portion having a circular passage extending therethrough at least at one end; a metal ring rotatably disposed in said circular passage, said metal ring having an open segment area; a latch member movably supported in said handle portion; said handle portion having a narrow cavity and spring means having interconnected undulated sections arranged in spaced parallel relationship disposed and contained in said cavity for biasing said latch member toward said metal ring and into said open segment area when said open segment area is in the path of movement of said latch member for locking said ring in position; said latch member being movably supported in said handle portion in a passage which intersects, and extends normal to, said circular passage, and said latch member further having a portion extending at least to the surface of said handle portion at least at one side thereof so as to permit movement of said latch member out of engagement with said metal ring in order to allow rotation of the metal ring for removal and insertion of keys.

2. A key ring as recited in claim 1, wherein said spring means has at least at one end thereof a latch cam adapted to be received in said open segment area of said metal ring for locking said metal ring.

3. A key ring as recited in claim 2, wherein said spring and latch member consist of a single piece formed of plastic material.

4. A key ring as recited in claim 2, wherein said latch cams have openings formed therethrough and said handle portion has slide members slidably mounted therein, said slide members having projections extending into said cam openings for actuating said cams.

5. A key ring as recited in claim 2, wherein the sides of said latch cams are inclined such that the latch cams are wedge-shaped.

6. A key ring comprising: a handle portion having a circular passage extending therethrough at least at one end thereof; a metal ring rotatably disposed in said circular passage, said metal ring having an open segment area; a latch member movably supported in said handle portion; said handle portion having a narrow cavity and spring means having interconnected undulated sections arranged in spaced parallel relationship disposed and contained in said cavity for biasing said latch member toward said metal ring and into said open segment area when said open segment area is in the path of movement of said latch member; the end faces of said metal ring defining said open segment area being inclined so as to define a wedge-formed open segment area of increased width at the radially outer end thereof, and said latch member being a body of circular cross-section forced into said open segment area by said spring means but displaceable therefrom by forceful rotation of said metal ring.

7. A key ring as recited in claim 1 or 6 wherein said spring means consists of elastomeric material.

* * * * *